US006732403B2

(12) United States Patent
Moore et al.

(10) Patent No.: US 6,732,403 B2
(45) Date of Patent: May 11, 2004

(54) PORTABLE CLEANING ASSEMBLY

(76) Inventors: Glen E. Moore, 22807 Violet St., St Clair Shores, MI (US) 48082; Susan J. Williamson, 6511 Clarkston Rd., Clarkston, MI (US) 48346

( * ) Notice: Subject to any disclaimer, the term of this patent is extended or adjusted under 35 U.S.C. 154(b) by 225 days.

(21) Appl. No.: 10/116,768

(22) Filed: Apr. 4, 2002

(65) Prior Publication Data

US 2002/0152577 A1 Oct. 24, 2002

Related U.S. Application Data

(60) Provisional application No. 60/282,047, filed on Apr. 7, 2001, and provisional application No. 60/317,366, filed on Sep. 4, 2001.

(51) Int. Cl.[7] ..... A47L 5/00; A47L 7/00; A47L 9/00

(52) U.S. Cl. ..... 15/339; 15/323; 15/327.6; 15/352

(58) Field of Search ..... 15/310, 323, 327.1, 15/327.2, 327.6, 327.7, 339, 352, DIG. 8, DIG. 10

(56) References Cited

U.S. PATENT DOCUMENTS

| | | | | |
|---|---|---|---|---|
| 971,895 | A | 10/1910 | Joedicke | |
| 2,531,920 | A | 11/1950 | Raminger | |
| 2,779,432 | A | 1/1957 | Meyerhoefer | |
| 3,328,826 | A | 7/1967 | Amos | |
| 4,699,641 | A | 10/1987 | Barnes | |
| 5,205,013 | A | 4/1993 | Lopes | 15/301 |
| 6,058,560 | A | 5/2000 | Gab et al. | 15/339 |
| 6,199,714 | B1 | 3/2001 | Thompson | 220/495.07 |
| RE37,350 | E | 9/2001 | Stephan | |

*Primary Examiner*—Terrence R. Till
(74) *Attorney, Agent, or Firm*—Howard & Howard

(57) ABSTRACT

The subject invention provides a portable cleaning assembly. The assembly includes a vacuum body and a vacuum unit. The vacuum body has a receiving channel extending from the top of the vacuum body. The assembly further includes a waste container supported on top of the vacuum body, wherein the bottom of the waste container is supported. The bottom of the waste container also separates the vacuum body from the waste container, such that waste container is separate and distinct from the vacuum body and removable from the vacuum body. A transport mechanism supports the vacuum body and the waste container thereof for moving the vacuum body and the waste container across the area while applying the vacuum and for independently filling the waste container with waste.

31 Claims, 5 Drawing Sheets

PORTABLE CLEANING ASSEMBLY

RELATED APPLICATIONS

This application claims priority to U.S. Provisional Patent Applications having Ser. No. 60/282,047 filed on Apr. 7, 2001 and No. 60/317,366 filed on Sep. 4, 2001.

BACKGROUND OF THE INVENTION

1. Field of the Invention

The subject invention relates to a portable cleaning assembly, and specifically to a portable vacuum unit and waste container.

2. Description of the Related Art

The related art assemblies disclose a vacuum body having a vacuum unit for applying a vacuum to clean an area such that the assembly is hidden and therefore not visible. One such assembly, shown in U.S. Pat. No. 5,205,013, includes a vacuum housed in a decorative storage and is designed to receive a plant to conceal the vacuum from view. The assembly is primarily for use in barbershops and hair salons. The vacuum has an inlet such that the vacuum does not have to be removed from the storage to be utilized. However, the vacuum is not portable and does not allow for collection of solid debris that cannot be vacuumed. Another assembly disclosed in U.S. Pat. No. 3,328,826 includes a vacuum unit housed in a hassock. The hassock conceals the vacuum from view, but does not include a container for receiving solid waste.

The related art assemblies also disclose a waste container attached to the vacuum body for receiving waste. U.S. Pat. No. 6,058,560 discloses an assembly having a vacuum attached to a waste container. The vacuum has an inlet for attachment to a hose, which is preferably 20 feet length, to allow the vacuum to be utilized in an area without having to move the assembly. Further, the '560 patent suggests having multiple units disposed throughout the area so that the assemblies remain in the current location, without having to be moved. U.S. Pat. No. 6,199,714 discloses an assembly having a waste container housing a vacuum unit. The vacuum unit has an inlet in the bottom of waste container for cleaning up swept debris and for cleaning off dustpans. However, the waste container must be picked up and carried from one area to the next.

The related art assemblies are characterized by one or more inadequacies. Specifically, the assemblies do not provide a mechanism for making the waste container and vacuum unit portable for cleaning large areas. The assemblies require additional passes through the area to perform specific cleaning functions, such as one pass for waste removal and another for vacuuming debris. These assemblies also require the user to carry the waste to the assembly or carry the assembly, which becomes increasingly heavy and burdensome.

SUMMARY OF THE INVENTION AND ADVANTAGES

The subject invention provides a portable cleaning assembly. The assembly includes a vacuum body and a vacuum unit disposed in the vacuum body for applying a vacuum to clean an area. A waste container is supported on top of the vacuum body for collecting waste that can not be vacuumed or from other waste receptacles. The assembly also includes a transport mechanism supporting the vacuum body and the waste container thereof for moving the vacuum body and the waste container across the area while applying the vacuum and for independently filling the waste container with waste.

Accordingly, the subject invention overcomes the inadequacies that characterize the related art assemblies. The subject invention is portable which allows the assembly to be utilized to clean large commercial areas, such as office buildings, airports, malls, and the like. Only a single pass is required through the areas because waste receptacles can be emptied into the waste container and any debris on the ground can be vacuumed, simultaneously. Also, the subject invention provides for more efficient transportation of the waste container, as the container becomes increasingly heavy as more waste is put into the container.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
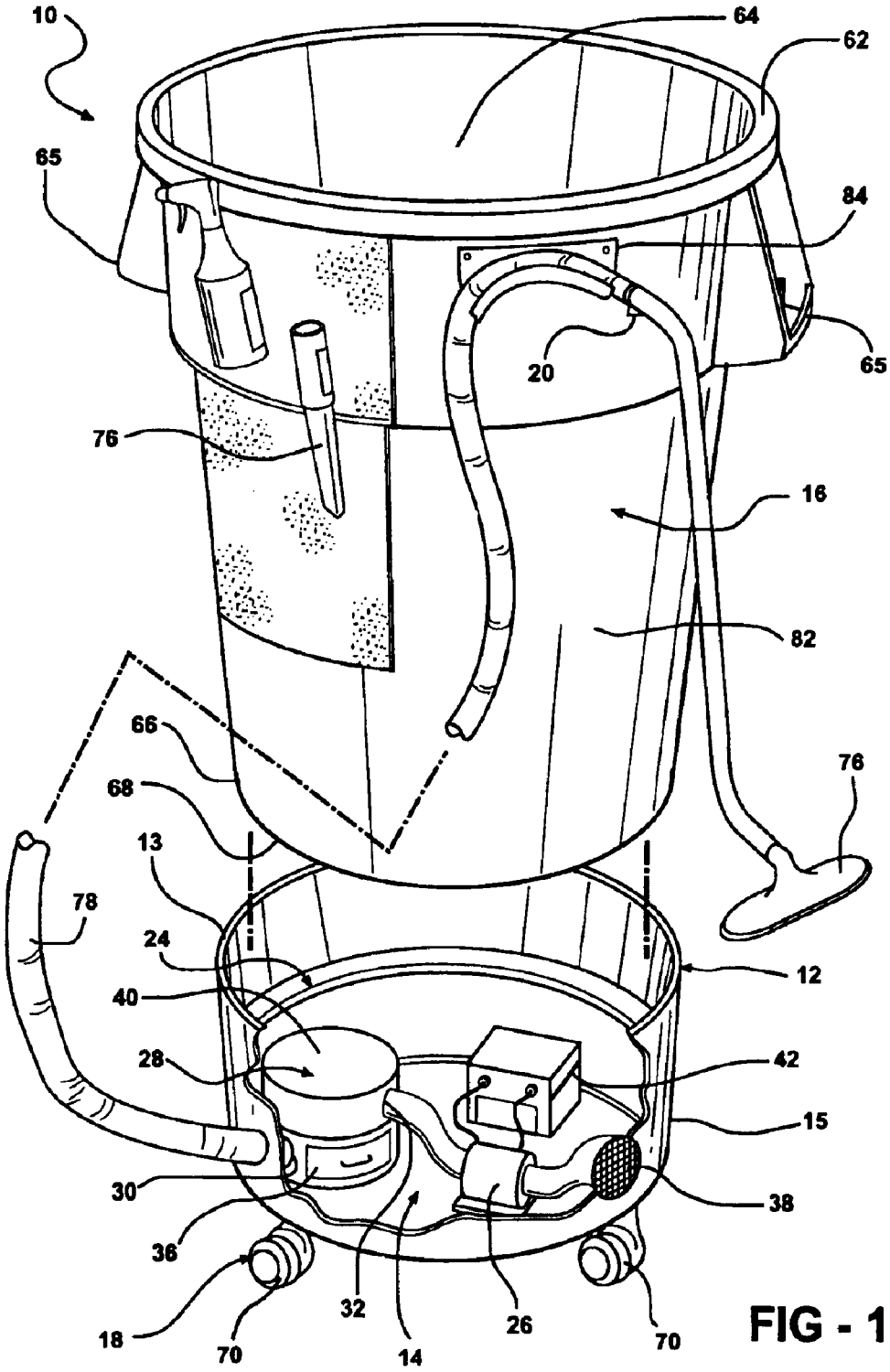
FIG. 1 is a perspective view of a portable cleaning assembly having a vacuum body, waste container, and transport mechanism according to the subject invention.

Referring to the Figures, wherein like numerals indicate like or corresponding parts throughout the several views, a portable cleaning assembly is illustrated generally at 10. The assembly 10 includes a vacuum body 12, a vacuum unit 14, a waste container 16, and a transport mechanism 18.

Figure 2:
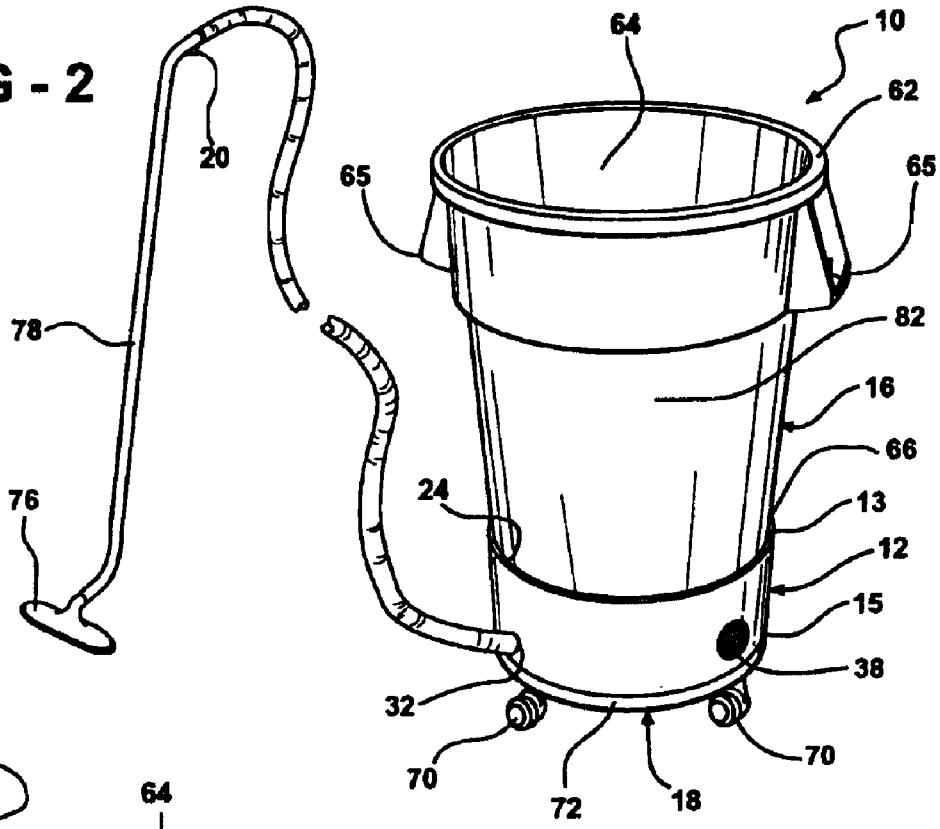
FIG. 2 is a perspective view of the assembly of FIG. 1 having the vacuum body supporting the waste container.
Figure 6:
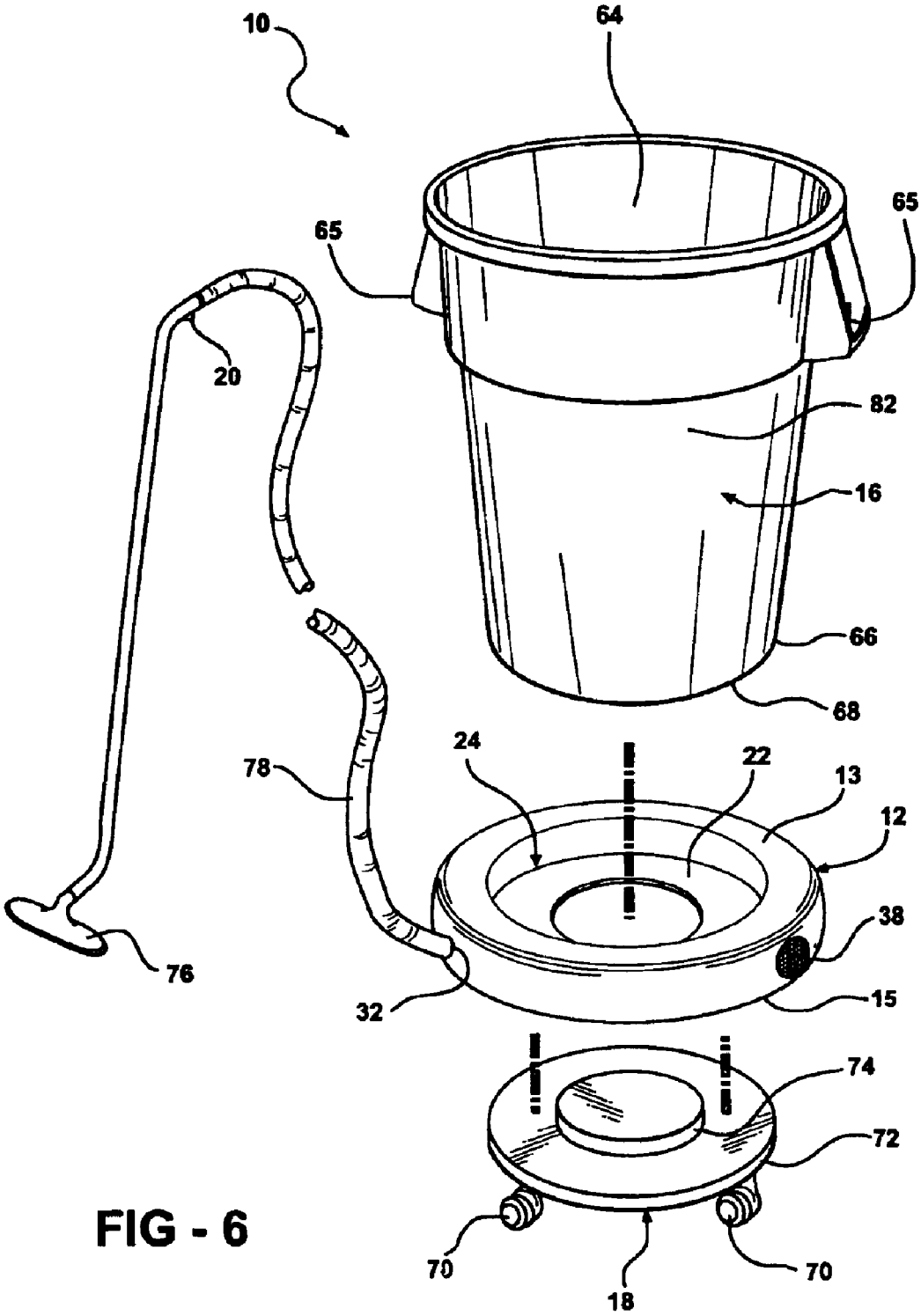
FIG. 6 is a perspective view of another embodiment of the vacuum unit.

Referring to FIGS. 1 and 2, the assembly 10 includes the vacuum body 12 and the vacuum unit 14. The vacuum body 12 has a top 13 and a bottom 15. The vacuum body 12 has a receiving channel 24 extending from the top 13 of the vacuum body 12. The receiving channel 24 may be formed integrally with the top 13 and may be recessed within the top 13 of the vacuum body 12. The vacuum unit 14 is disposed in the vacuum body 12 for applying a vacuum to clean an area. The vacuum unit 14 is preferably in the bottom 15 of the vacuum unit 14. It is to be understood that the vacuum unit 14 may be positioned differently, as shown in FIG. 6, where the vacuum unit 14 is housed in a circular vacuum body 12. The vacuum body 12 and vacuum unit 14 may be a Shop-Vac® brand vacuum cleaner as is commercially available or any other type of commercially available vacuum cleaner. However, it is preferable that the vacuum unit 14 and vacuum body 12 are as described below.

Figure 4:
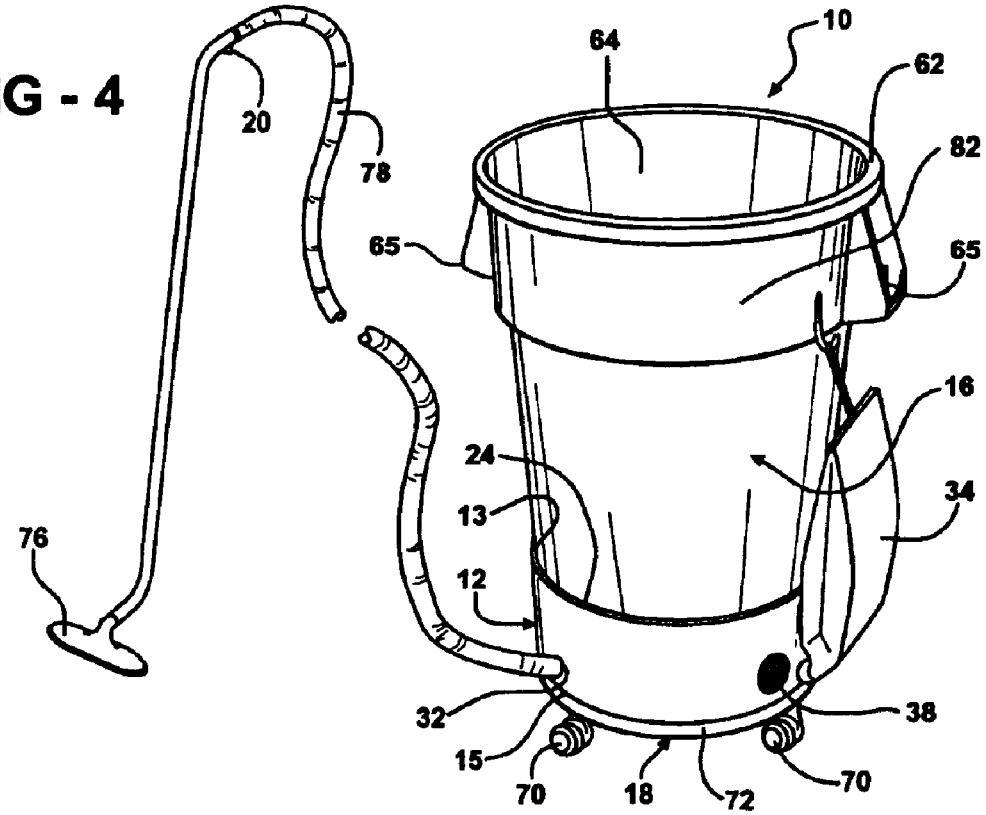
FIG. 4 is a perspective view of the debris collection device attached to the waste container.
Figure 7:
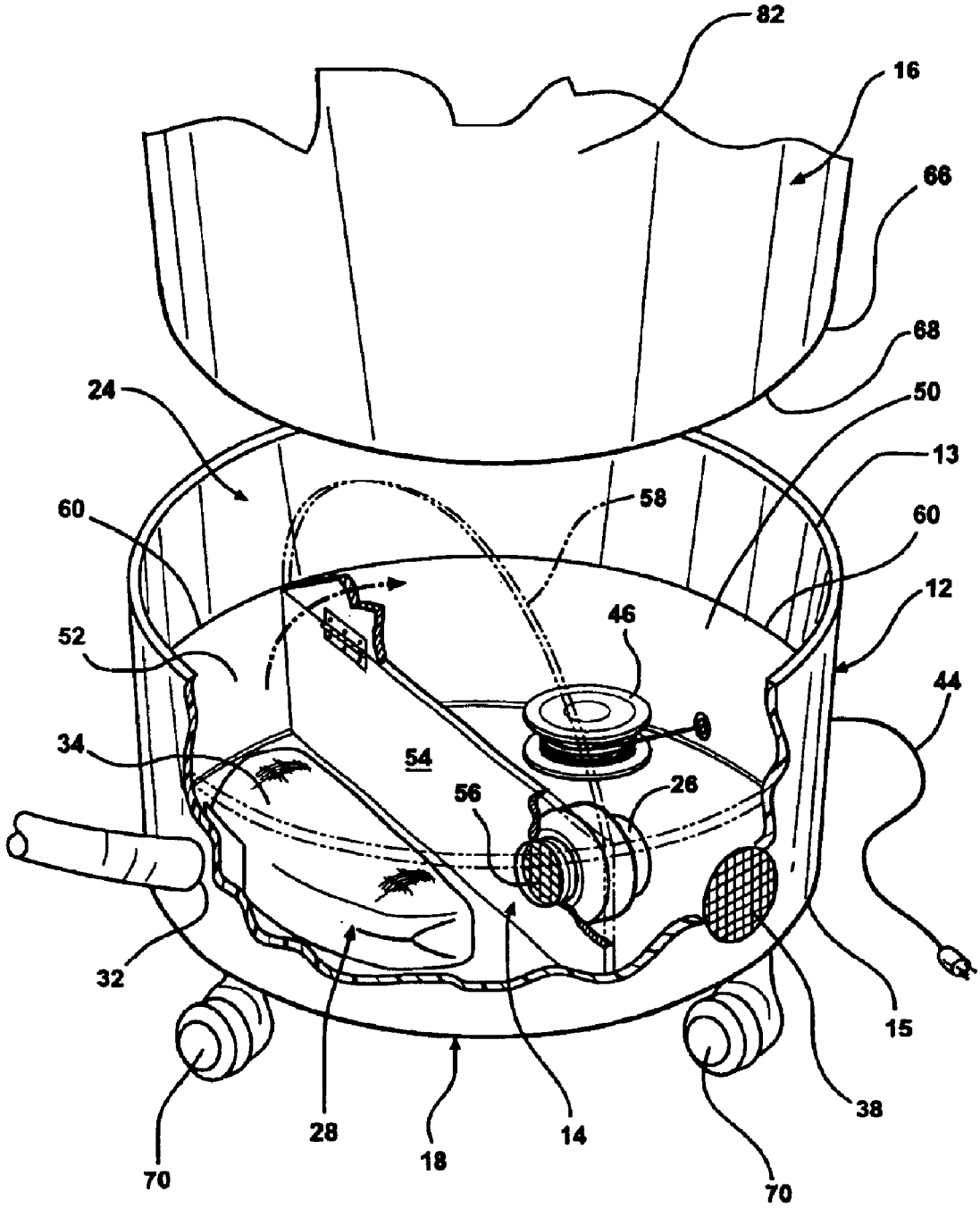
FIG. 7 is a perspective view yet another embodiment of the vacuum unit.

Referring back to FIG. 1, the vacuum unit 14 includes a motor 26 housed within the vacuum unit 14 for creating the vacuum. A debris collection device 28 having an inlet 30 and an outlet 32 is connected to the motor 26 for collecting debris. It is preferable that the outlet 32 is connected to the motor 26 for applying suction, as is known in the vacuum arts. However, the motor 26 may not be directly connected to the debris collection device 28, as described below. The debris collection device 28 may be either a vacuum bag 34 or a pull drawer 36 disposed between and in fluid communication with the inlet 30 and the outlet 32. The vacuum bag 34 is preferably porous and connected to the inlet 30. The porous bag 34, as shown in FIG. 7, does not need to be directly connected to the outlet 32, because the motor 26 creates a suction that pulls the air through the porous bag 34, thereby creating the vacuum. In another embodiment, the vacuum bag 34 may be supported outside of the vacuum body 12 to allow for easy removal, as shown in FIG. 4, in which case the vacuum unit 14 operates as a standard upright vacuum as is known in the art. It is to be appreciated by one skilled in the art that the standard upright vacuum includes a blower motor connected to the inlet of the porous vacuum bag 34. The debris is pulled into the blower motor and blown into the vacuum bag 34. Additionally, the vacuum body 12 and the waste container 16 may be a single unitary housing being integrally formed.

The vacuum unit 14 also has ventilation holes 38 disposed in the vacuum body 12 for allowing exhaust from the suction of the motor 26 to escape from the vacuum unit 14. A filter 40, shown in FIG. 1, is disposed between and in fluid communication with the inlet 30 and the outlet 32 for use specifically with the pull drawer 36. However, the filter 40 may also be used with the porous bag 34, if desired. The filter 40 enables the assembly 10 to be used with fine and ultra-fine particles, such as dust. The filter 40 may be removed and replaced as necessary.

Figure 5:
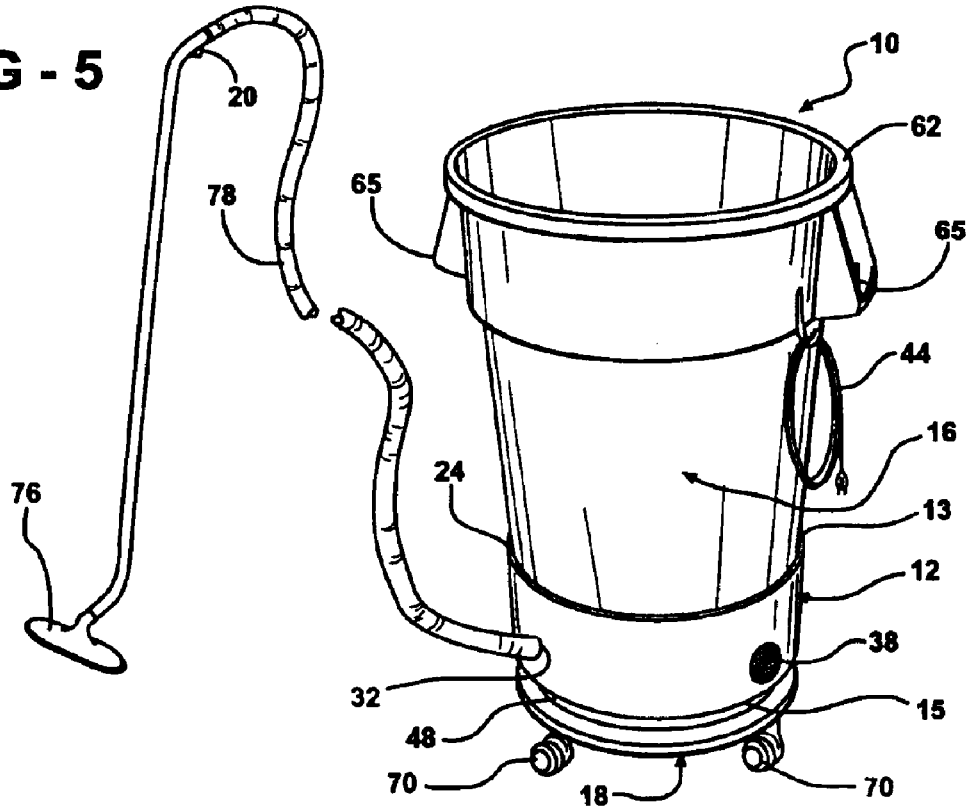
FIG. 5 is a perspective view of another embodiment of the vacuum unit.

The vacuum unit 14 further includes a power source 42 for operating the motor 26. The power source 42 may be a battery supported by the vacuum body 12 or may be a cord 44 connected to the motor 26 for connection to an electrical circuit of a building. In one embodiment, a cord reel 46 is disposed within the vacuum unit 14 for receiving the cord 44. Alternately, the cord reel 46 may be integrally formed with the vacuum unit 14 for receiving the cord 44. As shown in FIG. 5, the cord reel 46 has a groove 48 for receiving the cord 44 and wrapping the cord 44 around the vacuum body 12.

Preferably, the vacuum unit 14 is divided into a first compartment 50 for housing the motor 26 and a second compartment 52 for housing the debris collection device 28 by a divider 54, as shown in FIG. 7. The second compartment 52 is preferably sealed from the rest of the vacuum body 12 and the first compartment 50. The first compartment 50 has the ventilation holes 38 for the motor 26 exhaust. The divider 54 has a hole 56 for allowing the motor 26 to be connected to the outlet 32 of the debris collection device 28. The motor 26 is operated and creates suction through the hole and since the second compartment 52 is sealed, air flow is drawn from the inlet 30, through the hole and out the exhaust of the motor 26. The divider 54 further includes an access door 58 hingedly connected to the divider 54 for sealing the second compartment 52. The access door 58 has a seal 60 engaging the vacuum body 12 and the divider 54 such that the suction created by the motor 26 is not lessened. The access door 58 allows a user to access and empty the debris collection device 28 through the access door 58. The user may also replace the filter 40 through the access door 58. However, the pull drawer 36 may be removable from outside the vacuum body 12 for emptying debris.

The assembly 10 further includes the waste container 16 supported on top of the vacuum body 12. The waste container 16 is preferably a circular fifty-five or a forty-four gallon barrel. However, differently shaped and sized containers may be utilized depending upon the particular applications. The waste container 16 has an upper end 62 with an opening 64 and a lower end 66 with a bottom 68. The opening 64 is designed to receive and secure a waste liner to store any waste deposited therein. The waste container 16 further includes handles 65 extending therefrom for enabling removal from the vacuum body 12. A lid (not shown) may be disposed on the upper end 62 for enclosing the waste container 16.

Figure 3:
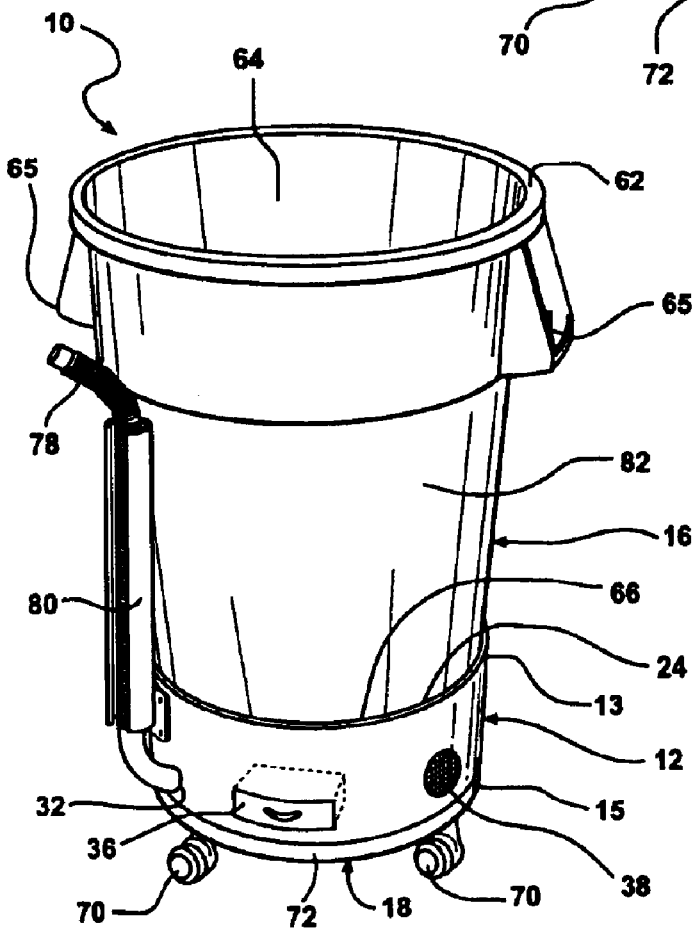
FIG. 3 is a perspective view of the portable cleaning assembly having an alternate debris collection device.

The vacuum body 12 supports the bottom 68 of the waste container 16. The bottom 68 of the waste container 16 may be secured to the top 13 of the vacuum body 12 by any desired means. However, it is preferable that the lower end 66 engages the receiving channel 24 for receiving and supporting the waste container 16. The bottom 68 of the waste container 16 also separates the vacuum body 12 from the waste container 16, such that waste container 16 is separate and distinct from the vacuum body 12. The divider 54 may also support the bottom 68. The waste container 16 is therefore removable from the vacuum body 12. Alternately, the waste container 16 and the vacuum body 12 may be integrally formed as a unitary housing, when the debris collection device is accessible, as shown in FIG. 3. When the waste container 16 becomes full, the waste container 16 is removed from the vacuum body 12 and emptied. The empty waste container 16 is then replaced back on top of the vacuum body 12. The waste container 16 may also be supported by a flange 22 extending from the receiving channel 24 of the circular vacuum body 12, as shown in FIG. 6.

The transport mechanism 18 supports the vacuum body 12 and the waste container 16 thereof for moving the vacuum body 12 and the waste container 16 across the area while applying the vacuum and for independently filling the waste container 16 with waste. The transport mechanism 18 is further defined as wheels 70 supporting the vacuum body 12 for moving the assembly 10. Preferably, the wheels 70 include at least three castors attached to the vacuum body 12. Of course, it is to be understood that different types of wheels 70 may be utilized depending upon the type of vacuum body 12 and waste container 16. In one embodiment, a base 72 supports the vacuum body 12 and the wheels 70 extend from the base 72, as shown in FIGS. 3 and 4. Therefore, the vacuum body 12 may be removed from the base 72. In another embodiment, the vacuum body 12 may be integrally formed with the base 72, such that the wheels 70 would extend directly from the vacuum body 12. Referring to FIG. 6, the base 72 also has raised portions 74 for engaging the vacuum body 12. The raised portion may engage the flange of the circular vacuum body 12.

Referring back to FIG. 1, the vacuum unit 14 includes a plurality of vacuum attachments 76 for connecting to the inlet 30 of the debris collection device 28. One of the vacuum attachments 76 includes a hose 78 connected to the inlet 30 for collecting debris and other attachments 76 may connect to the hose 78. The hose 78 has an on/off switch 20 for turning the vacuum unit 14 on and off. This allows for power conservation because the user can quickly and effortlessly turn off the vacuum when not required without having to bend over. The hose 78 may be flexible, collapsible, or the like, depending upon the particular applications. In FIG. 3, a hose tube 80 may be connected to the waste container 16 for storing the hose 78. Once the waste container 16 is supported on the vacuum body 12, an exterior surface 82 is formed between the waste container 16 and the vacuum body 12 for securing the vacuum attachments 76 thereto. In addition to vacuum attachments 76, other accessories and cleaning supplies, as in FIG. 1, may be attached to the exterior surface 82, such as key holders, spray bottles, squeegees, and the like. It is preferable that the exterior surface 82 be continuous between the waste container 16 and vacuum body 12. It should be appreciated that if the vacuum body 12 is larger then the waste container 16, the exterior surface 82 is not continuous and that the vacuum attachment may be connected to only one of the vacuum body 12 or the waste container 16. The exterior surface 82 may have a hook fastener disposed on the exterior surface 82 and the vacuum attachments 76 may have a loop fastener for securing the vacuum attachments 76 thereto. Alternately, the loop fastener may be on the exterior surface 82 and the hook fastener on the attachments 76. The hook fastener has stiff little hooks on it, while the loop fastener is soft and fuzzy, which is commercially available as Velcro®. The Velcro® may be covering the entire exterior surface 82 or as small patches for attaching the attachments thereto. The subject invention may also include a hose rest 84 extending from the exterior surface 82 for supporting the vacuum attachments 76 and specifically, the hose 78.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A portable cleaning assembly comprising;

a vacuum body;

a vacuum unit disposed in said vacuum body for applying a vacuum to clean an area;

a waste container supported on top of said vacuum body;

a transport mechanism supporting said vacuum body and said waste container thereof for moving said vacuum body and said waste container across the area while applying the vacuum and for independently filling said waste container with waste.

2. An assembly as set forth in claim 1 wherein said transport mechanism is further defined as wheels supporting said vacuum body for moving said assembly.

3. An assembly as set forth in claim 2 wherein said wheels are further defined as at least three castors attached to said vacuum body.

4. An assembly as set forth in claim 2 further including a base having said wheels extending therefrom and supporting said vacuum body.

5. An assembly as set forth in claim 4 wherein said vacuum body is removable from said base.

6. An assembly as set forth in claim 4 wherein said vacuum body is integrally formed with said base.

7. An assembly as set forth in claim 1 wherein said waste container is removable from said vacuum body.

8. An assembly as set forth in claim 7 wherein said vacuum body further includes a receiving channel for receiving and supporting said waste container.

9. An assembly as set forth in claim 8 wherein said waste container further includes an upper end having an opening and a lower end having a bottom such that said bottom is received in said receiving channel and separates said vacuum body from said waste container.

10. An assembly as set forth in claim 9 wherein said waste container further includes handles extending therefrom for enabling removal from said vacuum body.

11. An assembly as set forth in claim 1 wherein said vacuum unit further includes a motor for creating the vacuum.

12. An assembly as set forth in claim 11 wherein said vacuum unit further includes a debris collection device connected to said motor for collecting debris.

13. An assembly as set forth in claim 12 wherein said debris collection device includes an inlet and an outlet, said inlet being connected to said motor.

14. An assembly as set forth in claim 13 wherein said debris collection device further includes a vacuum bag disposed in fluid communication with said motor.

15. An assembly as set forth in claim 14 further including a hose connected to said motor for blowing debris into said vacuum bag.

16. An assembly as set forth in claim 12 wherein said debris collection device includes an inlet and an outlet, said outlet being connected to said motor.

17. An assembly as set forth in claim 16 wherein said debris collection device further includes a filter disposed between and in fluid communication with said inlet and said outlet.

18. An assembly as set forth in claim 17 wherein said debris collection device further includes a vacuum bag disposed between and in fluid communication with said inlet and said filter.

19. An assembly as set forth in claim 17 wherein said debris collection device further includes a pull drawer disposed between and in fluid communication with said inlet and said filter.

20. An assembly as set forth in claim 17 further including a hose connected to said inlet for collecting debris.

21. An assembly as set forth in claim 17 further including ventilation holes disposed in said vacuum body for allowing exhaust to escape from said vacuum unit.

22. An assembly as set forth in claim 17 wherein said vacuum unit further includes a power source for operating said motor.

23. An assembly as set forth in claim 17 further including a cord reel disposed within said vacuum unit for receiving a cord.

24. An assembly as set forth in claim 17 including a cord reel integrally formed with said vacuum unit for receiving a cord.

25. An assembly as set forth in claim 12 wherein said vacuum unit further includes a first compartment for housing said motor and a second compartment for housing said debris collection device.

26. An assembly as set forth in claim 25 further including a divider for dividing said first compartment from said second compartment and for creating a seal between said vacuum body and said waste container.

27. An assembly as set forth in claim 26 wherein said divider further includes an access door hingedly connected to said second compartment for enclosing said debris collection device.

28. An assembly as set forth in claim 1 further including vacuum attachments for connecting to said vacuum unit for applying said vacuum to the area and wherein said vacuum body and said waste container have an exterior surface for securing said vacuum attachments thereto.

29. An assembly as set forth in claim 28 further including a hook and loop fasteners disposed on said exterior surface and said vacuum attachments for securing said vacuum attachments thereto.

30. An assembly as set forth in claim 28 further including a hose rest extending from said exterior surface for supporting said vacuum attachments.

31. An assembly as set forth in claim 1 wherein said vacuum body and said waste container are integrally formed as a unitary housing.

* * * * *